US007849984B2

(12) United States Patent
Whalen et al.

(10) Patent No.: US 7,849,984 B2
(45) Date of Patent: Dec. 14, 2010

(54) COLLAPSIBLE BAG MOUNTING STRUCTURE AND COLLAPSIBLE BAG ASSOCIATED THEREWITH

(75) Inventors: John H. Whalen, Sheridan, IL (US); Lisa Crandall, Elgin, IL (US); Katherine Hurt, Elgin, IL (US)

(73) Assignee: Plano Molding Company, Plano, IL (US)

( * ) Notice: Subject to any disclaimer, the term of this patent is extended or adjusted under 35 U.S.C. 154(b) by 152 days.

(21) Appl. No.: 12/016,073

(22) Filed: Jan. 17, 2008

(65) Prior Publication Data

US 2009/0183961 A1 Jul. 23, 2009

(51) Int. Cl.
*A45C 5/14* (2006.01)
*A45C 7/00* (2006.01)
*A45C 13/00* (2006.01)

(52) U.S. Cl. ..... 190/18 A; 190/18 R; 190/107

(58) Field of Classification Search ..... 190/18 A, 190/107, 18 R, 102, 108; 280/37
See application file for complete search history.

(56) References Cited

U.S. PATENT DOCUMENTS 3,974,898 A * 8/1976 Tullis et al. ..... 190/3
4,273,222 A * 6/1981 Cassimally et al. ..... 190/18 A
D357,354 S 4/1995 Marchwiak et al.
5,431,262 A * 7/1995 Rekuc et al. ..... 190/18 A
5,431,428 A 7/1995 Marchwiak et al.
5,743,363 A * 4/1998 Rekuc et al. ..... 190/18 A
6,179,101 B1 * 1/2001 Lin ..... 190/103
6,196,366 B1 * 3/2001 Lin ..... 190/18 A
6,227,339 B1 * 5/2001 Bogert ..... 190/18 R
6,267,393 B1 * 7/2001 Mengrone et al. ..... 280/37
6,460,668 B1 10/2002 Godshaw et al.
6,550,592 B1 4/2003 Godshaw et al.
6,561,327 B1 5/2003 Godshaw
6,604,616 B2 * 8/2003 Cheng ..... 190/24
6,604,617 B2 * 8/2003 Davis et al. ..... 190/107
6,666,363 B2 12/2003 Godshaw et al.
6,695,107 B2 2/2004 Godshaw et al.
6,840,359 B2 1/2005 Godshaw
6,926,129 B2 * 8/2005 Hoberman ..... 190/107
7,004,295 B2 2/2006 Godshaw et al.
7,048,101 B2 5/2006 Godshaw et al.
7,048,102 B2 5/2006 Godshaw et al.
7,147,089 B2 12/2006 Godshaw et al.
D553,362 S 10/2007 Godshaw et al.
7,311,200 B2 12/2007 Godshaw et al.
7,314,126 B2 1/2008 Godshaw et al.

(Continued)

*Primary Examiner*—Sue A Weaver
(74) *Attorney, Agent, or Firm*—McGuirewoods LLP

(57) ABSTRACT

A collapsible bag includes a flexible bag with a first side panel having a bottom edge and a bottom panel connected to the bottom edge to define a juncture between the first side panel and the bottom panel. A bracket is connected to the flexible bag adjacent the juncture and includes a transport wheel assembly. Additionally, a telescoping handle is connected to the bracket and the first side panel and extends from the juncture. A support assembly is movably connected at a proximate end to the bracket and connected at a distal end to the bottom panel such that the bottom panel is selectively movable between an operable orientation defined when the bottom panel is disposed transverse to the telescoping handle and the first side panel and a storage orientation defined when the bottom panel is disposed parallel to the telescoping handle and the first side panel.

17 Claims, 5 Drawing Sheets

U.S. PATENT DOCUMENTS

| | | | | |
|---|---|---|---|---|
| 7,331,454 | B2 | 2/2008 | Godshaw et al. | |
| 2002/0130005 | A1 * | 9/2002 | Schwartz | 190/107 |
| 2004/0144606 | A1 * | 7/2004 | Han | 190/18 A |
| 2005/0016808 | A1 * | 1/2005 | Sapyta | 190/107 |
| 2005/0016810 | A1 * | 1/2005 | Feng | 190/115 |
| 2006/0011686 | A1 * | 1/2006 | Latham | 224/579 |
| 2008/0135365 | A1 * | 6/2008 | Han | 190/107 |

* cited by examiner

COLLAPSIBLE BAG MOUNTING STRUCTURE AND COLLAPSIBLE BAG ASSOCIATED THEREWITH

FIELD OF THE DISCLOSURE

This disclosure generally relates to a container, e.g., luggage, a suitcase, or a bag, and more particularly to a collapsible bag.

BACKGROUND

Containers such as bags and other similar devices, e.g., suitcases, luggage items, cases, etc., exist to, among other things, help a person easily transport items. For example, travelers often use suitcases to easily transport clothes and other items when traveling to a remote destination. A container that is rigid in nature has an advantage of helping to protect the contents of the container. A disadvantage of many known rigid containers, however, is that they are not easily stored. For example, when not in use, people often store containers, (e.g., suitcases) with nothing in them. In so doing, the containers may take up valuable space with nothing but air inside them. As another disadvantage, it is not economical to ship such containers when empty.

To overcome this disadvantage, one known solution has been to use a collapsible bag rather than a container with a more rigid or semi-rigid structure. Thus, a user may, in one form or another, expand the volume within the container when using the container to carry items and then, when not in use, may collapse the container so as to store the bag in a space-saving mode, i.e., the bag has a space saving shape. For example, containers may be made from a soft, flexible sides that may be folded or otherwise compacted next to the bottom of a bag. As one example, such a container may be a duffel bag, which may have a rigid bottom if desired.

Such solutions, however, are not without their problems. For example, duffel bags may not be appropriate appearance-wise for some situations. Furthermore, flexible containers are often to construct with other advantageous features of containers, such as telescoping handles and wheels to facilitate the ease of transport.

Thus, a need exists for an improved container (e.g., suitcase, bag, luggage item).

SUMMARY

A collapsible bag includes a flexible bag with a first side panel having a bottom edge and a bottom panel connected to the bottom edge to define a juncture between the first side panel and the bottom panel. A bracket is connected to the flexible bag adjacent the juncture and includes a transport wheel assembly. Additionally, a telescoping handle is connected to the bracket and the first side panel and extends from the juncture. A support assembly is movably connected at a proximate end to the bracket and connected at a distal end to the bottom panel such that the bottom panel is selectively movable between an operable orientation defined when the bottom panel is disposed transverse to the telescoping handle and the first side panel and a storage orientation defined when the bottom panel is disposed parallel to the telescoping handle and the first side panel.

In another example, the bottom panel includes a support area adjacent to the juncture and a bottom plate contiguous to the support area, and a pivot mechanism pivots the bottom plate between the operable orientation and the storage orientation. Furthermore, the support assembly, in another example, includes a slidably connected collar to lock the support assembly in the operable orientation when the collar is slid to the proximate end of the support assembly.

In yet another example, the support assembly includes support legs for resting the collapsible bag on the ground.

In yet another example, the transport wheel assembly includes two sets of two transport wheels.

In yet another example, the collapsible bag further includes a second and a third side panel connected to the bottom panel and forming an inside volume. Each side panel includes an inside surface with a first securing means for holding a separator panel attached to first securing means by a second securing means. In one example, the first and second securing means are respectively opposite sides of a hook and loop material.

In yet another example, the bracket may include reinforcement ribs.

BRIEF DESCRIPTION OF THE DRAWINGS

The invention may best be understood by reference to the following description taken in conjunction with the accompanying drawings. In the figures, like reference numerals identify like elements.

DETAILED DESCRIPTION

Figure 1:
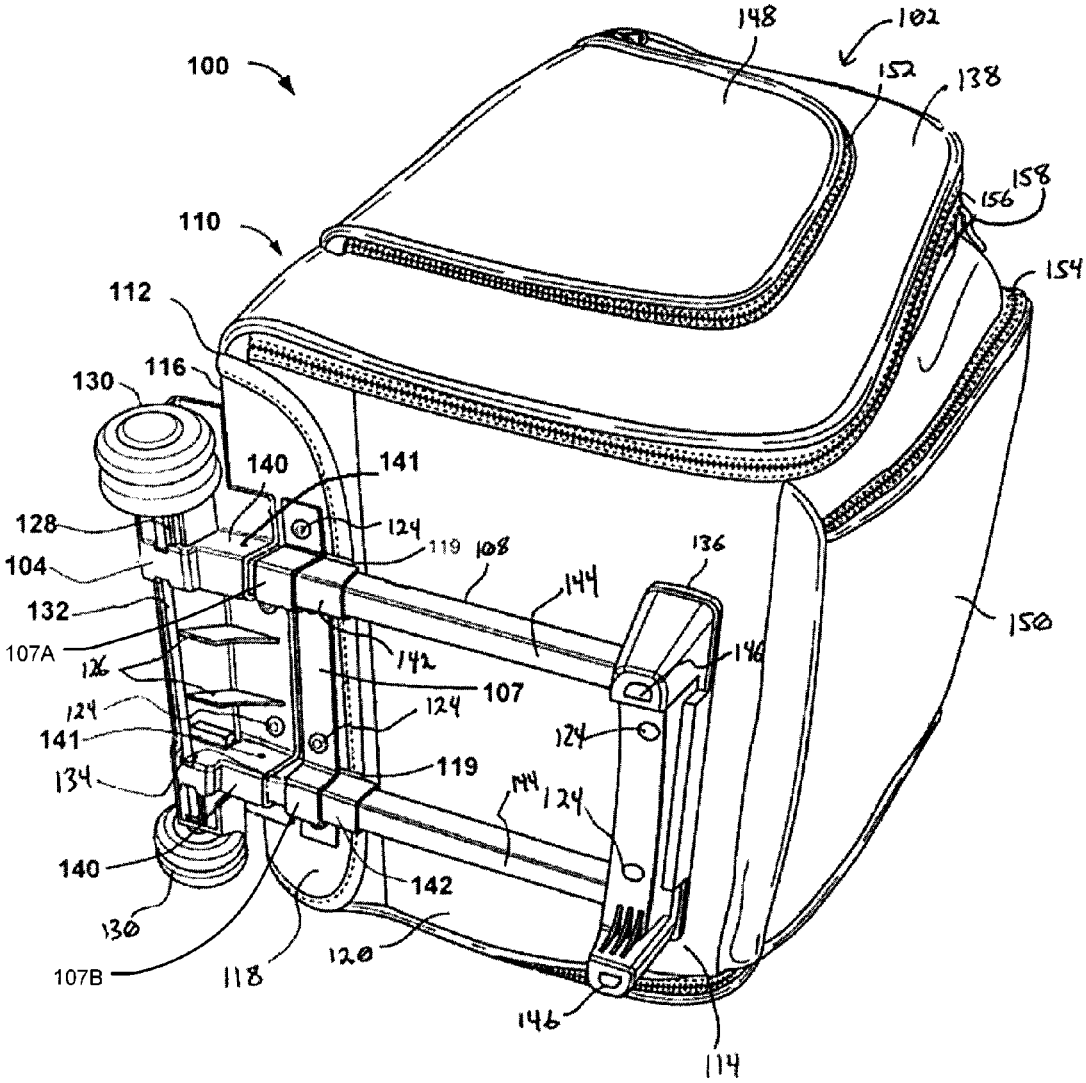
FIG. 1 is a three dimensional perspective view of an example of a collapsible bag in an operable orientation.

For the purpose of promoting and understanding the principles disclosed herein, reference will now be made to the preferred embodiments illustrated in the drawings, and specific language will be used to describe the same. It is nevertheless understood that no limitation of the scope of the actual invention is intended by the description of suggested embodiments. Such alterations and further modifications in the illustrated device and such further applications of the principles disclosed as illustrated herein are contemplated as would normally occur to one skilled in the art to which this disclosure relates.

FIGS. 1-5 show various views of a collapsible bag 100. Collapsible bag 100 includes a flexible bag 102, a bracket 104, a telescoping handle 106, and a support assembly 108. The flexible bag 102 has a first side panel 110, having a bottom edge 112. Flexible bag 102 also contains bottom panel 114, which is connected to the first side panel 110 to form a juncture 116. Juncture 116 may be formed by any suitable means. For example, the juncture 116 may be formed by sewing bottom panel 114 so the first side panel 110 or that the two may be fastened with snaps, buttons, rivets, or any other suitable fastener. It is further contemplated that the first side panel 110 and bottom panel 114 may be formed from one continuous piece of material folded along juncture 116. The top surface (not shown) of bottom panel 114 forms the bottom of collapsible bag 100.

The bottom panel 114 may have a support area 118 adjacent to the juncture 116 and a bottom plate 120 contiguous to the support area 118. For example, the support area 118 and bottom plate 120 may be made of any suitable material, such as a metal or plastic, although the support area 118 and bottom plate 120 could be made of the same material from which the flexible bag 102 is made. The bottom plate 120, among other things, causes the bottom panel 110 to be very rigid, which allows the collapsible bag 100 to be more like a traditional suitcase.

Bracket 104 is connected to flexible bag 102 adjacent the juncture 116. This connection may be made by any suitable connection means 124 known in the art, such as by rivets. Among other things, the bracket 104, in one example, includes reinforcement ribs 126. Reinforcement ribs 126 may be made of the same material as the bracket 104, such as a hardened plastic material, or may be formed from any other suitable material. When made of the same material, the reinforcement ribs 126 may be formed from the same mold as the bracket 104.

Bracket 104, in one example, further includes a transport wheel assembly 128. The transport wheel assembly 128, for example, may include two sets of two transport wheels 130. Furthermore, the two sets of two transport wheels 130 may be connected via a common axle 132. Although the axle 132 may force the sets of transport wheels 130 to rotate together, it is understood that each set of wheels, or even each independent wheel 130, may rotate independently, thereby allowing each wheel to rotate at different rates so as to increase the maneuverability of the container 100 during transport.

It is also contemplated that one example of a collapsible bag 100 has a telescoping handle 106, which is connected to the bracket 104 and the first side panel 110. Thus, telescoping handle 106 extends from juncture 116. As one skilled in the art will appreciate, the telescoping handle may be of any suitable form, and serves as a bag support to support first side panel 110. In one example, telescoping handle 106 may be placed in any one of three positions: a fully extended position, a partially extended position, and a stored position. In the stored position, the telescoping handle 106 is positioned such that it does not extend, or minimally extends, beyond the side panel 110. This position allows, among other things, the container 100 to be more compact to allow easier storage and easier transportation in environments such as planes. The handle may be extended via any suitable means. For example, the telescoping handle 106 may have extending members (e.g., "buttons") that extend from an interior part of the handle through one or more holes in the exterior of the telescoping handle 106 so as to lock the telescoping handle in the desired position, as known in the art. A user may then push a button or other mechanism on the handle portion of the telescoping handle 106 to cause the locking members to retract, thereby allowing a user to either extend or retract the telescoping handle 106, as known in the art.

Collapsible bag 100 also contains support assembly 108, serving as a bag support, which is connected at a proximate end 134 to the bracket 104 and connected at a distal end 136 to the bottom panel 114 such that the bottom panel is selectively movable between an operable orientation and a storage orientation. In an operable orientation, the bottom panel 114 is disposed transverse to the telescoping handle 106 and the first side panel 110. In this orientation, the collapsible bag 100 is expanded to form an inside volume in which items may be placed for transport. For example, collapsible bag 100 also includes second side panel 138 and third side panel 202 connected to the bottom panel 114 to form the inside volume.

Figure 5:
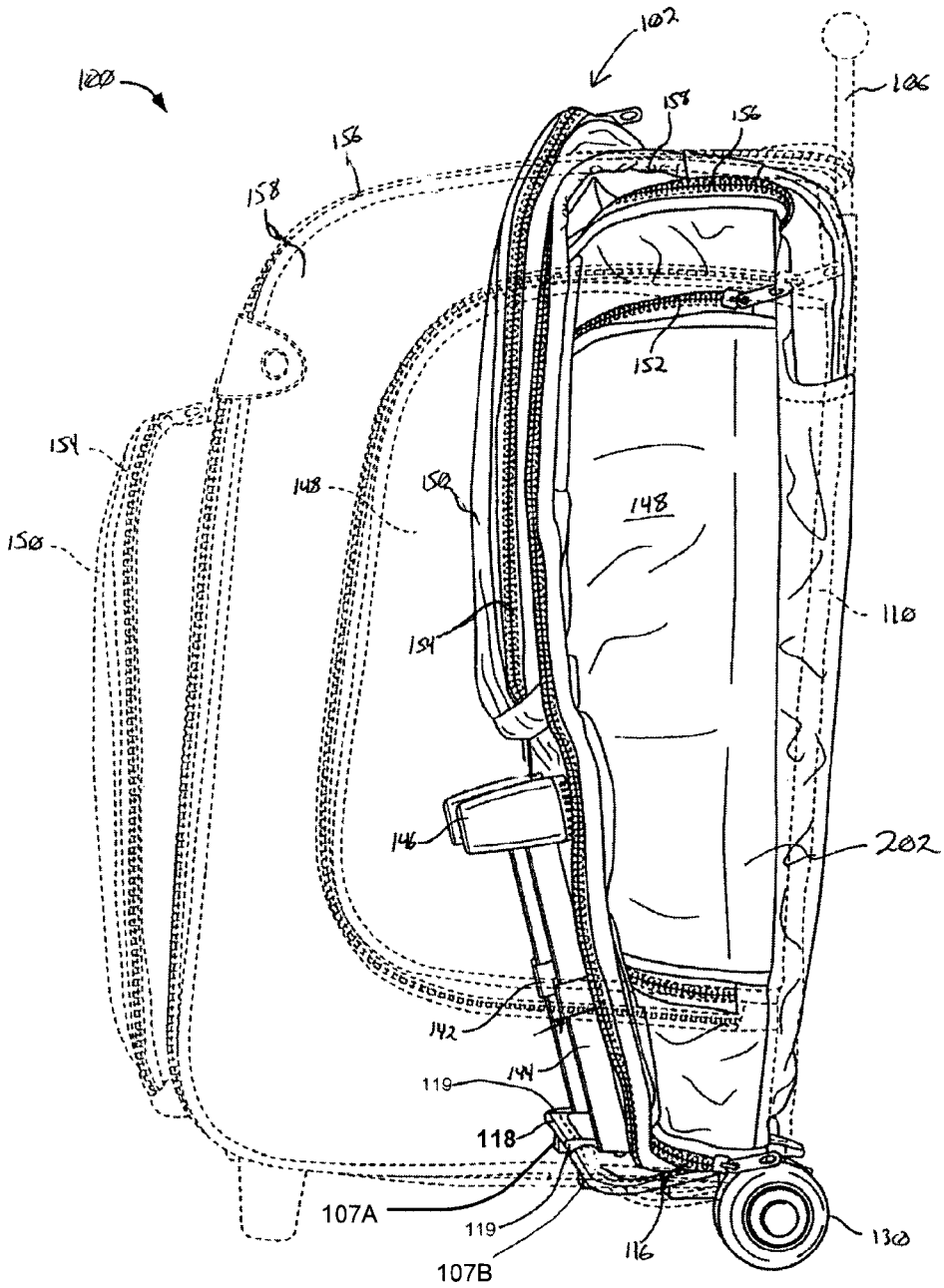
FIG. 5 is a side view of an example of a collapsible bag illustrating the bag in both an operable orientation (dotted lines) and a partial storage orientation (solid lines).

In the storage orientation, as best shown in FIG. 5 (although not fully collapsed), the bottom panel 114 is disposed parallel to the telescoping handle 106 and the first side panel 110. In this collapsed form, the defined inside volume of the collapsible bag 100 is minimized or even completely removed. As such, the collapsible bag 100 is in a preferred form for storing the bag when no items are placed within it. As one skilled in the art will appreciate, the collapsible bag 100 in a storage orientation will take up less space, for example, when being stored in a closet by a user or in a box by a retail store before selling to a customer.

Figure 3:
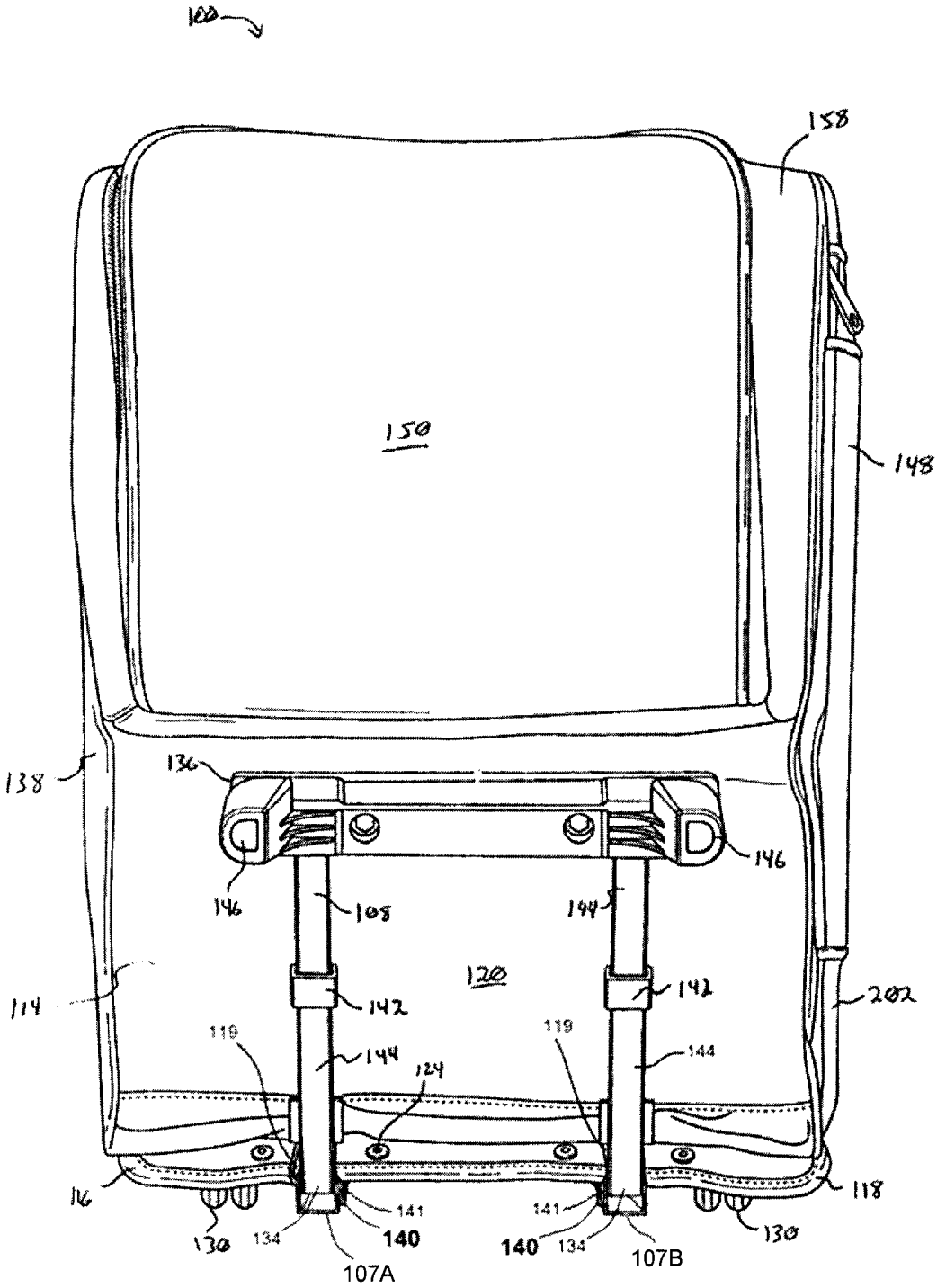
FIG. 3 is a side view of an example of a collapsible bag with a collar for locking the collapsible bag in an unlocked position.

As one skilled in the art will readily appreciate, a pivot mechanism 140 may allow the bottom plate 120 to pivot between the operable orientation and the storage orientation. The pivot mechanism 140 may be integral to the bracket 104. The pivot mechanism 140 may be attached to the support area 118, for example, by the connection means 124. The support area 118 may have cutout portions 119 extending along the support arms 144, respectively, such that, as shown in FIG. 3, a portion of the support arms 144 may be inserted into the respective cutout portions 119 when the support assembly 108 pivots from the operable orientation to the storage orientation. The support area 118 may be configured not to move between the operable orientation and the storage orientation when the bottom plate 120 pivots between the operable orientation and the storage orientation, as shown in FIG. 5. For example, the support assembly 108 may be hingedly connected to the bracket 104 such that the two may pivot with respect to each other. In one simple form, the support assembly 108 may have one or more holes (not shown) through which a pin 141 mounted to the bracket 108 may pass. As such, the support assembly 108 may rotate about the pin 141, thereby pivoting between the operable orientation and the storage orientation. One skilled in the art, however, will recognize that any other suitable pivot mechanism may be used.

The collapsible bag 100 may further include a support bar 107 located on the bottom panel 114 to prevent the support assembly 108 from pivoting downwardly from the operable orientation. The support bar 107 may be located adjacent to the bracket 104 and attached to the support area 118, for example, by the connection means 124. The support bar 107 may have u-shaped protruded portions 107A, 107B located corresponding to the support assembly 108. For example, the protruded portions 107A, 107B may be configured to engage the support arms 144 in order to keep the support assembly 108 in the operable orientation, as shown in FIG. 1. The support arms 144 may disengage from the protruded portions 107A, 107B when the support assembly 108 moving from the operable orientation to the storage orientation.

Figure 2:
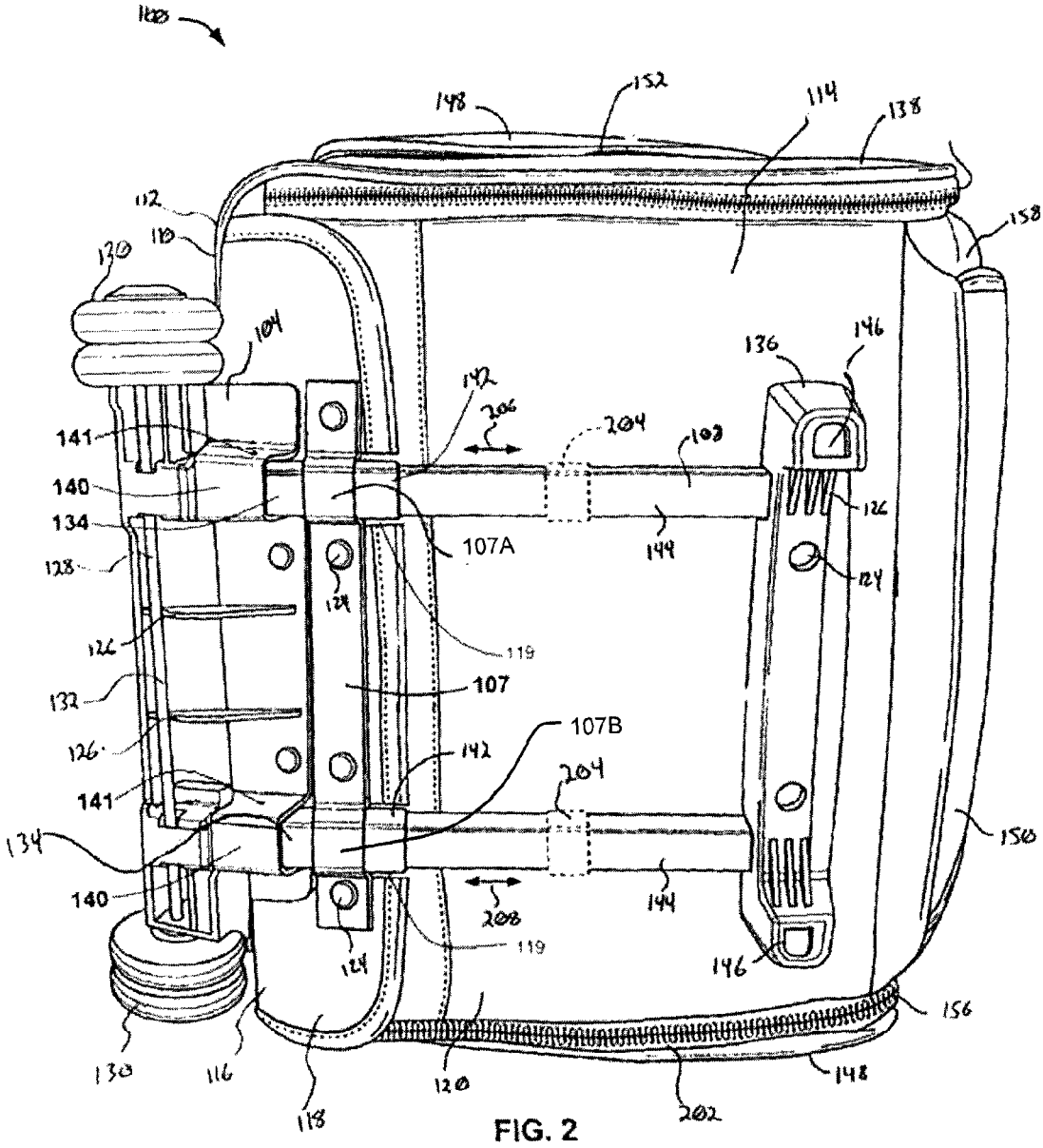
FIG. 2 is a three dimensional perspective view of an example of a collapsible bag in an operable orientation illustrating, among other things, a collar for locking the collapsible bag in the operable orientation.

In one example, the support assembly 108 may also include a slidably connected collar 142 to lock the support assembly 108 in the operable orientation when the collar 142 is slid to the proximate end 134 of the support assembly 108. The collar 142 may slide on the support arms 144. As shown in FIG. 2, for example, collar 142 is locking the collapsible bag 100 in an operable orientation, and dotted collars 204 show a position of the collars after they arc slid as indicated by arrows 206, 208. Collar 142 may lock the support assembly 108 into the operable orientation in any suitable way. In one example, each support arm 144 is smaller than the u-shaped protruded portions 107A, 107B of the support bar 107. The support arms 144 are thus set within the u-shaped protruded portions 107A, 107B such that the support arm 144 appears as an extension of the u-shaped protruded portions 107A, 107B of the support bar 107 when in the operable orientation, as shown, for example, in FIG. 1. When in this position, the collar 142 is just large enough to slide along the support arm 144 and snugly fit over the u-shaped protruded portions 107A, 107B of the support bar 107, thereby preventing the support arm 144 from pivoting. It is understood, however, that any suitable locking mechanism may be used.

Other example features of a collapsible bag 100 will be appreciated by one skilled in the art. For example, the support assembly 108 may include support legs 146 for resting the collapsible bag 100 on the ground. Furthermore, the collapsible bag 100 may include various pockets on the exterior surfaces of the panels forming the inside volume of the bag. For example, FIG. 1 shows side pocket 148 and front pocket 150. Note that a side pocket 148 is also illustrated in other figures on the side panel opposite the side panel shown in FIG. 1. Pockets 148 and 150 may be open or they may be reclosable. In the example embodiment illustrated in the figures, pockets 148, 150 include zippers 152, 154 that allow a user to close pockets 148, 150 so that items within the pockets do not fall out during transport. Zipper 156 is also shown that allows a user to place items in main, larger inner volume of the collapsible bag 100. As shown, for example, zipper 156 connects the front panel 158 to side panels 138 and 202. Front panel 158 also contains a portion 160 forming a top panel that the zipper 156 also connects to the first side panel 110, in addition to side panels 138, 202. It is understood that in each example where a zipper is shown, more than one zipper may be used. It is further understood that any suitable connecting means may be used, such as, for example, snaps, buttons a hook and loop material, or ties.

Figure 4:
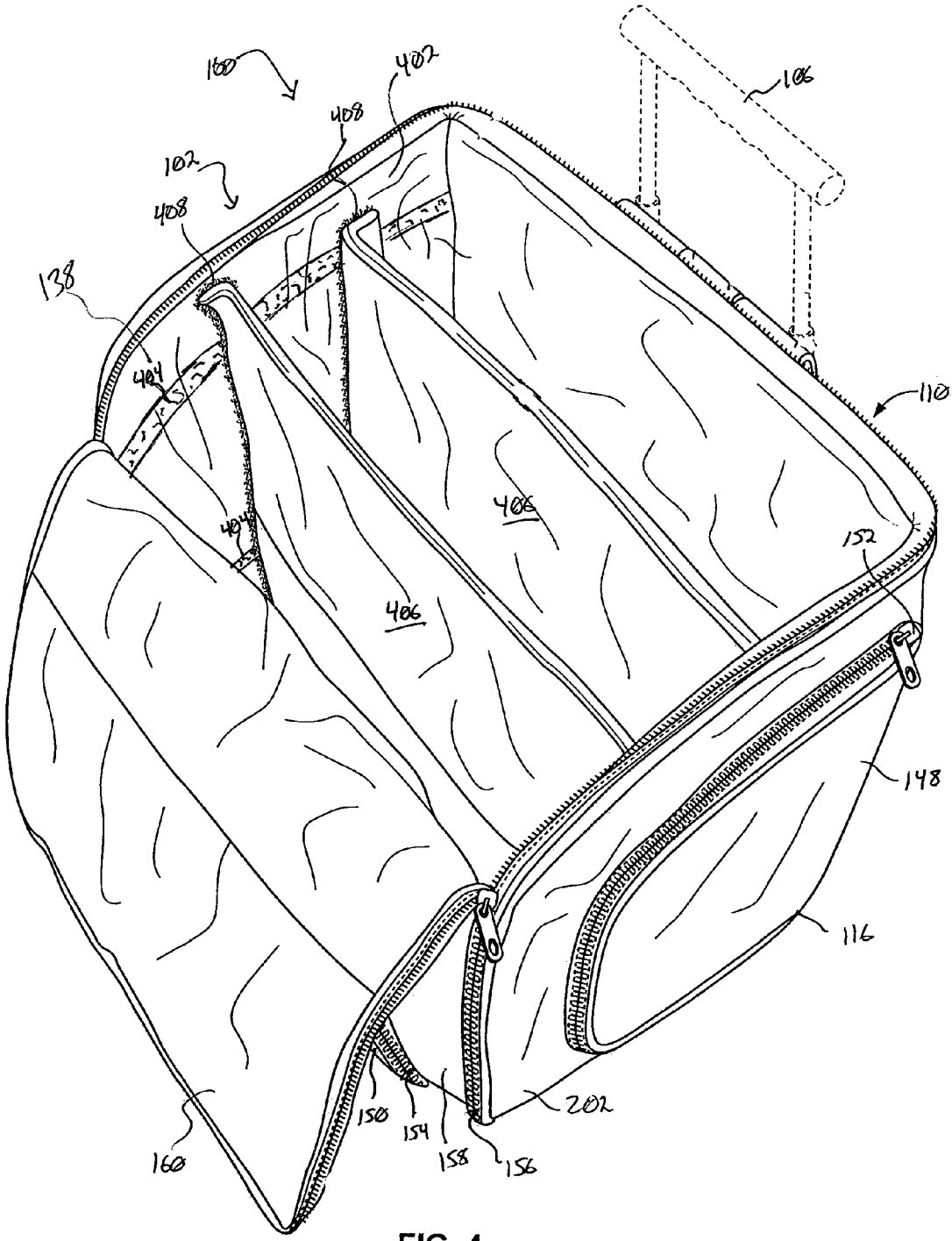
FIG. 4 is a top-side view of an example of a collapsible bag in an operable orientation, illustrating, among other things, separator panels disposed within an inside volume of the collapsible bag.

Yet another example feature of a collapsible bag is best shown in FIG. 4. Side panels 138 and 202 each have an inside surface with a first securing means 404 for holding a separator panel 406. In FIG. 4, two separator panels are shown, but it is understood that any number of separator panels may be used. Separator panels 406, among other things, allow a user to separate items inside collapsible bag 100 and also allow a user to create a smaller partition/volume in which to place items so that if the volume of the items is less than the inner volume of the collapsible bag 100, the items will not loosely move around within the collapsible bag 100 during transit. One skilled in the art will recognize other advantages. Each separator panel 406 has a second securing means 408 for holding the separator panel 406 to the first securing means 404.

Securing means 404 and the corresponding securing means 408 on the separator panels 406 may be any suitable securing means. For example, they may be hook and loop material, snaps, buttons, or ties. In the example shown in FIG. 4, two strips of hook and loop material 404 are shown on inside surface 402 of side panel 138. One advantage of having a continuous strip of hook and loop material along the inside surfaces 402 of the side panels 138, 202 is that the separator panels 406 may easily be moved to various positions within the inside volume of the collapsible bag 100.

Persons of ordinary skill in the art will appreciate that although the teachings of the disclosure have been illustrated in connection with certain embodiments, there is no intent to limit the disclosure to such embodiments. On the contrary, the intention of this disclosure is to cover all modifications and embodiments failing fairly within the scope of the teachings of the disclosure. For example, it is understood that a collapsible bag mounting structure may be independent from the collapsible bag itself. In one example, the collapsible bag mounting structure includes a bracket, a telescoping handle with a first bag support to support a first side panel of a collapsible bag, and the telescoping handle is connected to the bracket at a juncture along a first orientation. Furthermore, a transport wheel assembly is also connected to the juncture. The collapsible bag mounting structure also includes a support assembly with a second bag support located between the proximate end and the distal end to support the bottom panel of the collapsible bag. The support assembly is movably connected between an operable orientation, defined when the support assembly is in a second orientation substantially perpendicular to the first orientation of the telescoping handle, and a storage orientation, defined when the support assembly is substantially parallel to the first orientation. Other variations and embodiments will be recognized of being within the spirit and scope of this disclosure.

What is claimed is:

1. A collapsible bag comprising:

a flexible bag including a first side panel having a bottom edge and a bottom panel connected to the bottom edge of the first side panel to define a juncture between the first side panel and the bottom panel;

a bracket connected to the flexible bag adjacent the juncture and including a transport wheel assembly;

a telescoping handle connected to the bracket and the first side panel and extending from the juncture; and a support assembly movably connected at a proximate end to the bracket and connected at a distal end to the bottom panel such that the bottom panel is configured to selectively move between an operable orientation defined when the bottom panel is disposed transverse to the telescoping handle and the first side panel and a storage orientation defined when the bottom panel is disposed parallel to the telescoping handle and the first side panel, wherein the bottom panel comprises a support area located adjacent to the juncture and a bottom plate contiguous to the support area, the support area comprising a cutout portion to which a portion of the support assembly is inserted when the bottom plate moves from the operable orientation to the storage orientation, and wherein the bracket comprises a pivot mechanism attached to the support area of the bottom panel to pivot the support assembly between the operable orientation and the storage orientation, the support area configured not to move between the operable orientation and the storage orientation when the bottom plate moves between the operable orientation and the storage orientation.

2. The collapsible bag of claim 1, wherein the support assembly further comprises a slidably connected collar to lock the support assembly in the operable orientation when the collar is slid to the proximate end of the support assembly.

3. The collapsible bag of claim 2, wherein the support assembly further comprises support legs for resting the collapsible bag on the ground.

4. The collapsible bag of claim 1, wherein the transport wheel assembly includes two sets of two transport wheels.

5. The collapsible bag of claim 1, further comprising a second side panel and a third side panel connected to the first side panel and the bottom panel, wherein each of the second side panel and the third side panel includes an inside surface with a first securing means for holding a separator panel extending between the second side panel and the third side panel and attached to first securing means by a second securing means.

6. The collapsible bag of claim 5, wherein the first and second securing means are respectively opposite sides of a hook and loop material.

7. A collapsible bag comprising:

a collapsible enclosure having a bottom panel and four side panels, the bottom panel including a top surface, a support area, a bottom plate and an edge, whereby one of the four side panels is connected to the edge of the bottom panel to form a juncture;

a bracket located adjacent to the juncture, connected to the support area of the bottom panel and including a transport wheel assembly, the support area located adjacent the juncture and contiguous with the bottom plate;

a telescoping handle connected to the bracket and extending from the juncture; and a support assembly movably connected to a proximate end to the bracket and connected at a distal end to the bottom panel such that the bottom panel is movable between an operable orientation defined when the bottom panel is disposed transverse to the telescoping handle and a storage orientation defined when the bottom panel is disposed parallel to the telescoping handle, wherein the bracket comprises a pivot mechanism attached to the support area of the bottom panel to pivot the bottom plate between the operable orientation and the storage orientation, and wherein the support area comprises a cutout portion to which a portion of the support assembly is inserted when the bottom panel moves from the operable orientation to the storage orientation, the support area configured not to move between the operable orientation and the storage orientation when the bottom plate moves between the operable orientation and the storage orientation.

8. The collapsible bag of claim 7, wherein the support assembly comprises a slidably connected collar to lock the support assembly in the operable orientation when the collar is slid to the proximate end of the support assembly.

9. The collapsible bag of claim 8, wherein the support assembly further comprises support legs for resting the collapsible bag on the ground.

10. The collapsible bag of claim 7, wherein the transport wheel assembly includes two sets of two transport wheels.

11. The collapsible bag of claim 7, further comprising a second side panel and a third side panel connected to the bottom panel and the first side panel, wherein each of the second side panel and the third side panel includes an inside surface with a first securing means for holding a separator panel extending between the second side panel and the third side panel and attached to first securing means by a second securing means.

12. The collapsible bag of claim 11, wherein the first and second securing means are respectively opposite sides of a hook and loop material.

13. A collapsible bag mounting structure, comprising:

a bracket;

a telescoping handle with a first bag support to support a first side panel of a collapsible bag, the telescoping handle connected to the bracket at a juncture along a first orientation;

a transport wheel assembly connected to the juncture; and a support assembly with a second bag support located between a proximate end and a distal end to support a bottom panel of the collapsible bag, the support assembly movably connected between an operable orientation and a storage orientation to the bracket at the proximate end, the operable orientation defined when the support assembly is in a second orientation substantially perpendicular to the first orientation of the telescoping handle, and a storage orientation defined when the support assembly is substantially parallel to the first orientation, wherein the bottom panel comprises a support area located adjacent to the juncture and a bottom plate contiguous with the support area, the support area comprising a cutout portion to which a portion of the support assembly is inserted when the support assembly moves from the operable orientation to the storage orientation, the support area configured not to move between the operable orientation and the storage orientation when the bottom plate moves between the operable orientation and the storage orientation, and wherein the bracket comprises a pivot mechanism attached to the support area of the bottom panel to pivot the support assembly between the operable orientation and the storage orientation.

14. The collapsible bag mounting structure of claim 13, wherein the support assembly comprises a slidably connected collar to lock the support assembly in the operable orientation when the collar is slid to the proximate end of the support assembly.

15. The collapsible bag mounting structure of claim 14, wherein the support assembly further comprises support legs for resting the mounting structure on the ground.

16. The collapsible bag mounting structure of claim 13, wherein the transport wheel assembly includes two sets of two transport wheels.

17. The collapsible bag mounting structure of claim 13, wherein the bracket includes reinforcement ribs.

* * * * *